US011766597B2

(12) United States Patent
Bernard

(10) Patent No.: US 11,766,597 B2
(45) Date of Patent: Sep. 26, 2023

(54) BASEBALL TRAINING DEVICE

(71) Applicant: Gilbert Bernard, Sydney (CA)

(72) Inventor: Gilbert Bernard, Sydney (CA)

( * ) Notice: Subject to any disclaimer, the term of this patent is extended or adjusted under 35 U.S.C. 154(b) by 0 days.

(21) Appl. No.: 17/727,944

(22) Filed: Apr. 25, 2022

(65) Prior Publication Data

US 2022/0347542 A1 Nov. 3, 2022

Related U.S. Application Data

(60) Provisional application No. 63/183,228, filed on May 3, 2021.

(51) Int. Cl.
*A63B 69/36* (2006.01)
*A63B 69/00* (2006.01)

(52) U.S. Cl.
CPC ..... *A63B 69/0091* (2013.01); *A63B 69/0002* (2013.01); *A63B 2069/0008* (2013.01); *A63B 2225/093* (2013.01)

(58) Field of Classification Search
CPC ..... A63B 69/0091; A63B 69/0002; A63B 2069/0008; A63B 2225/093
USPC ..... 473/139, 145, 148, 188, 422, 423, 424, 473/427, 428, 429, 431, 455
See application file for complete search history.

(56) References Cited

U.S. PATENT DOCUMENTS

| | | | | |
|---|---|---|---|---|
| 5,788,589 | A * | 8/1998 | Koo | A63B 69/0091 473/429 |
| 5,833,555 | A * | 11/1998 | Jer-Min | A63B 69/0091 473/145 |
| 6,656,063 | B2 * | 12/2003 | Prichard | A63B 69/0091 473/145 |
| 11,219,809 | B2 * | 1/2022 | Cunnane | A63B 69/0091 |
| 2021/0060401 | A1 * | 3/2021 | Cunnane | A63B 69/0091 |

* cited by examiner

*Primary Examiner* — Nini F Legesse
(74) *Attorney, Agent, or Firm* — Brennan, Manna & Diamond, LLC

(57) ABSTRACT

The present invention relates generally to the field of baseball training devices. More specifically, the present invention relates to a baseball training device that is comprised of a base, first and second frame member, horizontal frame member, and vertical frame member that is further comprised of a baseball on each end. The vertical frame member rotates around the horizontal frame member and is stopped by a plurality of bristles that are fastened to the interior of the first and second frame members. When the rotation is stopped, one baseball is securely held within the bristles while the other baseball is teed up at the top of the device, allowing a user to strike the device indefinitely. Accordingly, the present disclosure makes specific reference thereto. Nonetheless, it is to be appreciated that aspects of the present invention are also equally applicable to other like applications, devices and methods of manufacture.

16 Claims, 3 Drawing Sheets

BASEBALL TRAINING DEVICE

CROSS-REFERENCE TO RELATED APPLICATION

The present application claims priority to, and the benefit of, U.S. Provisional Application No. 63/183,228 which was filed on May 3, 2021, and is incorporated herein by reference in its entirety.

FIELD OF THE INVENTION

The present invention relates generally to the field of baseball training devices. More specifically, the present invention relates to a baseball training device that is comprised of a base, first and second frame member, horizontal frame member, and vertical frame member that is further comprised of a baseball on each end. The vertical frame member rotates around the horizontal frame member and is stopped by a plurality of bristles that are fastened to the interior of the first and second frame members. When the rotation is stopped, one baseball is securely held within the bristles while the other baseball is teed up at the top of the device, allowing a user to strike the device indefinitely. Accordingly, the present disclosure makes specific reference thereto. Nonetheless, it is to be appreciated that aspects of the present invention are also equally applicable to other like applications, devices and methods of manufacture.

BACKGROUND

Many people enjoy the game of baseball. However, to play the game effectively, a player must develop their abilities and skills. One of the most important skills is hitting. This can be a difficult skill to develop if a player does not have coaches or friends who can constantly pitch a ball to them. Utilizing batting cages can be a costly endeavor that many players may not be able to afford. Others may not even live by a batting cage or hitting facility. Additionally, most traditional training methods require access to the outdoors or large training facilities. Even if players have access to all the necessary equipment and facilities, they still may be left with the annoying task of continuously chasing baseballs after they hit them.

Therefore, there exists a long-felt need in the art for a baseball training device. More specifically, there exists a long-felt need in the art for a baseball training device that helps a player train their swinging ability. Additionally, there exists a long-felt need in the art for a baseball training device that can automatically reset and tee up a new baseball a number of times. There also exists a long-felt need in the art for a baseball training device that is sturdy and balanced. Lastly, there exists a long-felt need in the art for a baseball training device that is aesthetically pleasing.

The subject matter disclosed and claimed herein, in one embodiment thereof, comprises a baseball training device. The device is primarily comprised of a base, a first frame member and a second frame member that receives a horizontal shaft, and a vertical shaft that has baseballs attached on the first and second end of the shaft. The vertical shaft is fastened to the horizontal shaft and is positioned between the first and second frame members. The vertical shaft may rotate around the horizontal shaft via rotating discs fastened to the horizontal shaft. The first and second frame members also feature brushes containing a plurality of bristles. The bristles act as a barrier to prevent the horizontal shaft from over-rotating. The first and second frame member are manufactured with slotted openings which the horizontal frame member extends through. In this manner, a user may adjust the height of the vertical frame member by maneuvering the horizontal frame member up or down the slotted grooves. The device is supported by a base plate, which can be customized with a plurality of indicia.

In this manner, the baseball training device of the present invention accomplishes all of the foregoing objectives and provides a device that allows a user to train their swinging abilities without the need to retrieve baseballs continuously and without the need for a second person. Additionally, because the device is made of durable materials and is fastened to a base, the device is well balanced and has a low chance of falling over after being struck. Lastly, the device is aesthetically pleasing.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a baseball training device. The device is primarily comprised of a base, a first frame member and a second frame member that receives a horizontal shaft, and a vertical shaft that has baseballs attached on the first end and second end of the shaft. The vertical frame member is fixedly attached to the horizontal shaft in between the first frame member and the second frame member. The first frame member and second frame member further have slotted openings. The horizontal shaft extends through the slotted openings and can be adjusted up or down the slotted opening to achieve a specific height. Once the desired height is found, the user can lock the device at said height using threaded knobs found on each end of the horizontal frame member. The first frame member and second frame member may further be fixedly or removably attached to the base plate. The base provides the device support and prevents the device from toppling over.

The horizontal shaft additionally comprises at least one rotating disc. In this manner, the vertical shaft can rotate around the horizontal shaft. This rotation is triggered when a user strikes one of the baseballs with a bat. The interior surface of the first frame member and the second frame member may have fixedly or removably attached brushes. The brushes, in turn, are comprised of a plurality of bristles. The vertical shaft preferably will stop after 180 degrees of rotation when it comes into contact with the bristles. This process will then tee up the second ball at the top of the device for another strike. This process may be repeated an indefinite number of times.

Accordingly, the baseball training device of the present invention is particularly advantageous as it allows a user to indefinitely swing at the training device without the need to constantly recover their baseballs. Additionally, because the baseballs are fixed to the device and automatically rotate into the optimal striking position, there is no need for a user to tee up new baseballs. In this manner, the baseball training device overcomes the limitations of existing baseball training devices known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
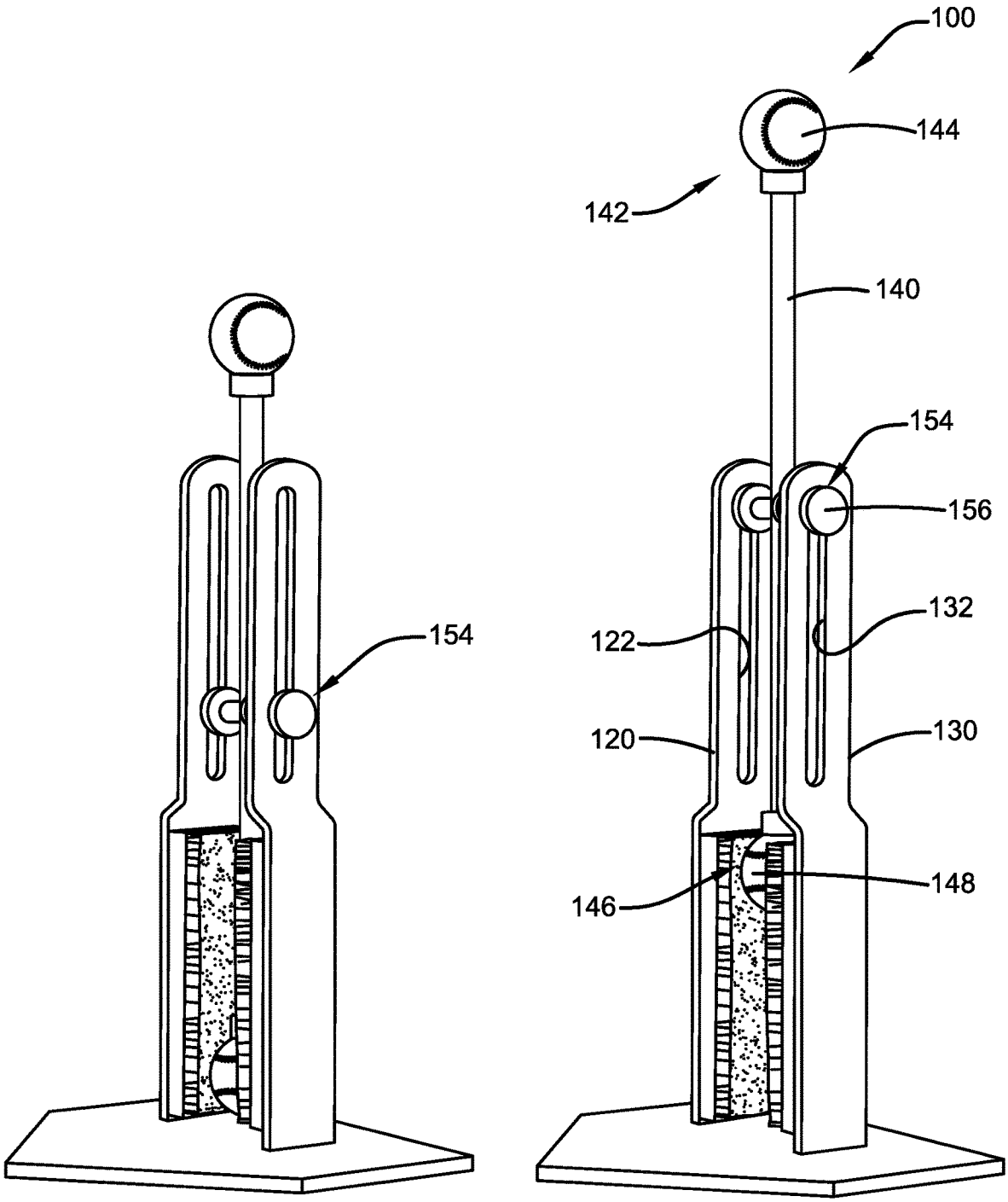
FIG. 1 illustrates multiple perspective views of one potential embodiment of a baseball training device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a baseball training device. There also exists a long-felt need in the art for a baseball training device that a player can use to improve their hitting ability. Moreover, there exists a long-felt need in the art for a baseball training device that resets after each swing and continues to do so an indefinite number of times. There also exists a long-felt need in the art for a baseball training device that is sturdy and balanced. Lastly, there exists a long-felt need in the art for a baseball training device that is aesthetically pleasing due to added indicia.

The present invention, in one exemplary embodiment, is comprised of a baseball training device. The device is primarily comprised of a base, a first frame member and a second frame member that receives a horizontal shaft, and a vertical shaft that further comprises a baseball attached on the first end and second end of the shaft. The vertical frame member attaches to the horizontal shaft between the first frame member and the second frame member. The first and second frame members are manufactured with slotted openings. The horizontal shaft extends through the slotted openings and has threaded knobs that may receive a head that can loosen or tighten the horizontal shaft to the first and second frame members. The user may adjust the horizontal frame member up or down the slotted opening to achieve the desired height. The first frame member and second frame member may be fixedly or removably attached to the base plate. The base offers the device balance and prevents the device from falling over after it is struck.

The horizontal shaft further comprises at least one rotating disc. In this manner, the vertical shaft may rotate around the horizontal shaft. This rotation occurs after a user strikes one of the baseballs with a baseball bat. The interior portion of the first frame member and the second frame member may be fixedly or removably attached with brushes. The brushes further comprise a plurality of bristles. The vertical shaft preferably will stop halfway through a rotation when it comes into contact with the bristles. This will then ready the second ball for another strike by teeing it up at the top of the device. This process may be repeated an indefinite number of times.

Referring initially to the drawings, FIG. 1 illustrates multiple perspective views of one potential embodiment of a baseball training device 100 of the present invention in accordance with the disclosed architecture. The device 100 is primarily comprised of a base 110, a first frame member 120 and a second frame member 130 that receives a horizontal shaft 150, and a vertical shaft 140 that has baseballs 114,148 attached on the first end 142 and second end 146 of the shaft 140. The first frame member 120, second frame member 130, and vertical shaft 140 are preferably manufactured from a durable metal such as, but not limited to: stainless steel or aluminum. In other embodiments, the first frame member 120, second frame member 130, and vertical shaft 140 may be manufactured from a rigid plastic material, such as but not limited to: acrylic, polycarbonate, polyethylene, thermoplastic, acrylonitrile butadiene styrene, low-density polyethylene, medium density polyethylene, high-density polyethylene, polyethylene terephthalate, polyvinyl chloride, polystyrene, polylactic acid, acetal, nylon, fiberglass, etc.

The first frame member 120 and the second frame member 130 each feature at least one slotted opening 122, 132 which receive the horizontal shaft 150. The horizontal shaft 150 is further comprised of at least one threaded knob 154 on each end, wherein each knob 154 has a thread-attached head 156. Loosening each head 156 (by turning one direction) allows the horizontal shaft 150 to be lowered or raised to position the vertical shaft 140 at the optimal height. Tightening each head 156 (by turning each head the opposite direction) locks the vertical shaft's 140 position in place. The first end 142 of the vertical shaft 140 comprises the first baseball 144, while the second end 146 of the vertical shaft 140 comprises the second baseball 148. When a user hits the first baseball 144, the vertical shaft 140 rotates around the horizontal shaft 150 and is stopped by a plurality of bristles 128. Once the vertical shaft's 140 rotation is stopped at 180 degrees, the second baseball 148 will then be in the top position. As a result, the user may strike the device 100 and continue this process a plurality of times, wherein the device 100 constantly delivers a baseball 144,148 for a user to hit.

Figure 2:
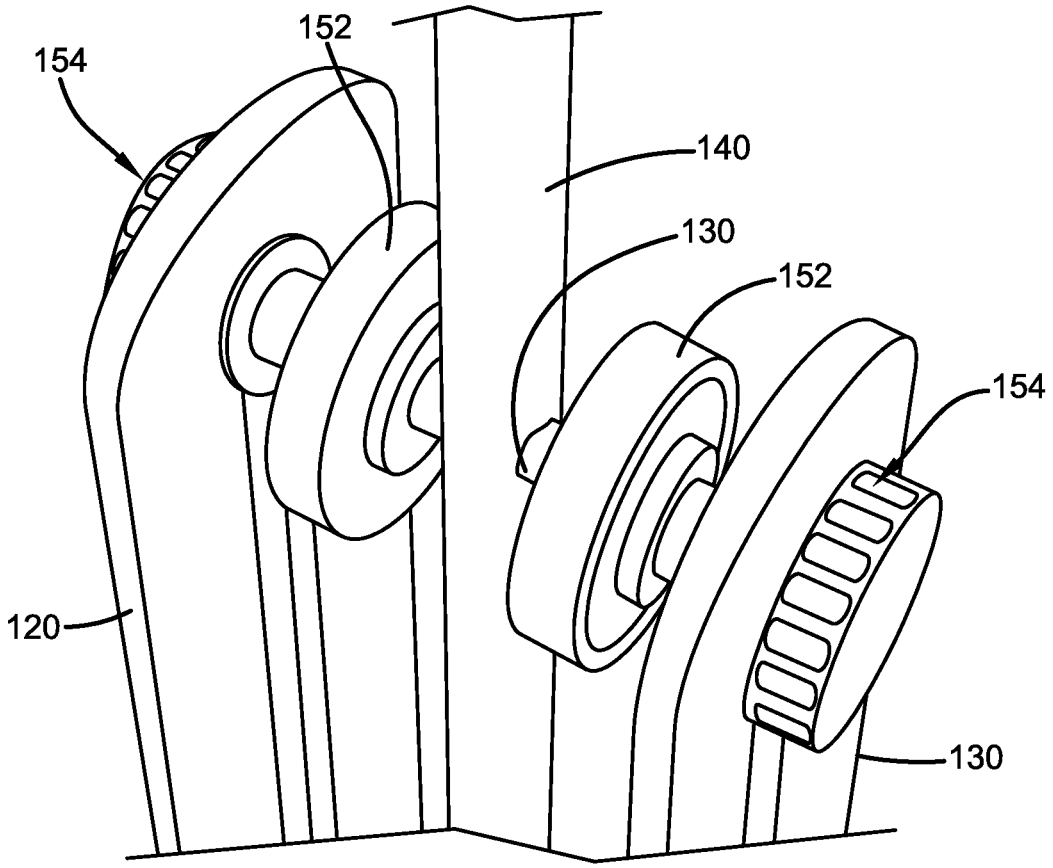
FIG. 2 illustrates an enhanced perspective view of one potential embodiment of a baseball training device of the present invention in accordance with the disclosed architecture.

FIG. 2 illustrates an enhanced perspective view of one potential embodiment of a baseball training device 100 of the present invention in accordance with the disclosed architecture. The vertical shaft 140 is fixedly connected to the horizontal shaft 150, which, in turn, is connected to at least one rotating disc 152. In the preferred embodiment, the horizontal shaft 150 will feature one rotating disc 152 on each side of the vertical shaft 140. The horizontal shaft 150 extends through the slotted opening 122 on the first frame member 120 and the slotted opening 132 on the second frame member 130. The horizontal shaft 150 comprises threaded knobs 154 on each side, and each threaded knob 154 may receive a head 156. The horizontal shaft 150 can be moved up or down along the slotted openings 122, 132 to align the vertical shaft 140 at the user's preferred height. The head 156 can be screwed onto the threaded knobs 154 to secure the horizontal shaft 140 in position along the slotted openings 132, 140.

Figure 3:
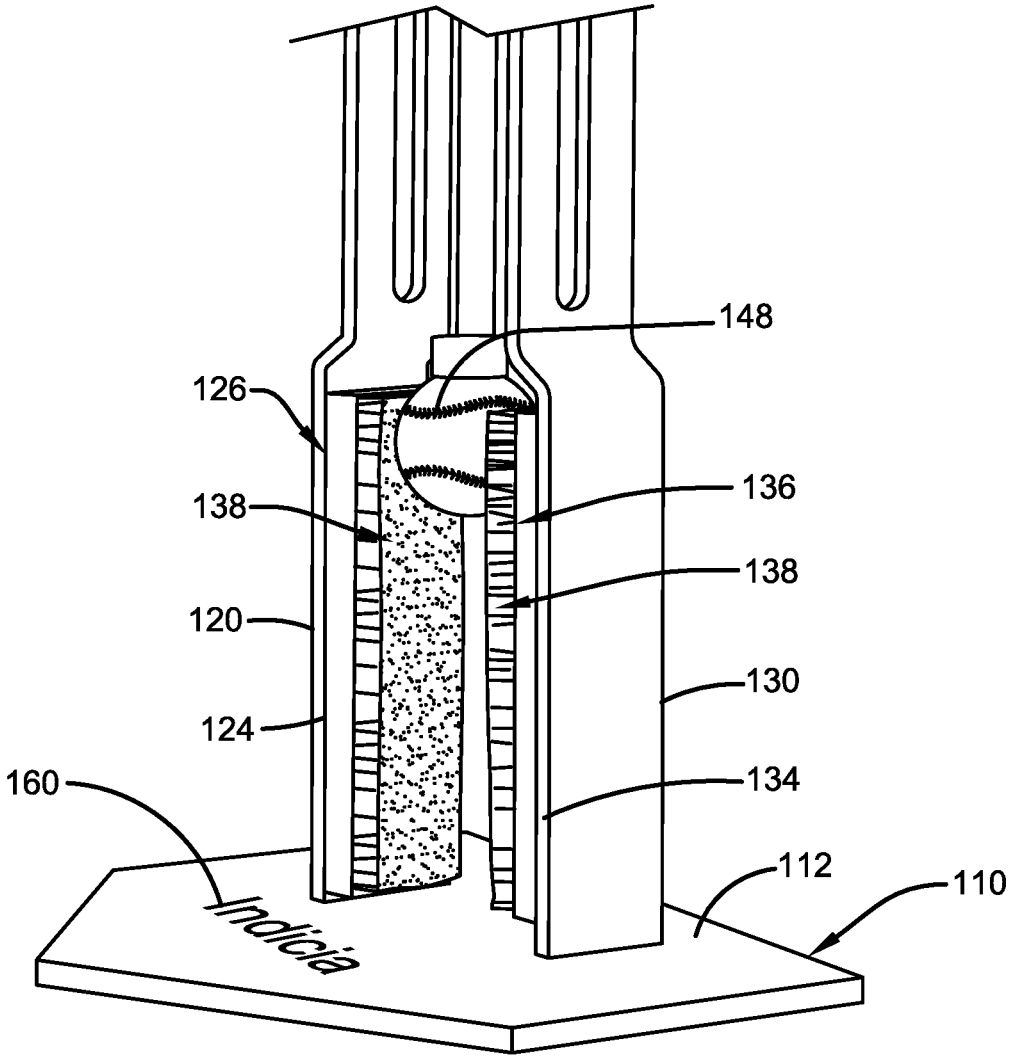
FIG. 3 illustrates an enhanced perspective view of one potential embodiment of a baseball training device of the present invention in accordance with the disclosed architecture.

FIG. 3 illustrates an enhanced perspective view of one potential embodiment of a baseball training device 100 of the present invention in accordance with the disclosed architecture. The interior surface 124 of the first frame member 120 features a fixedly or removably attached brush 126. The brush 126 is further comprised of a plurality of bristles 128 that extend into the opening space where the vertical shaft 140 rotates within the device 100. The interior surface 134 of the second frame member 130 also features a fixedly or removably attached brush 136. The brush 136 is further comprised of a plurality of bristles 138 that extend into the opening space where the vertical shaft 140 rotates within the device 100. In this manner, the bristles 138 of each brush 126,136 stop the vertical shaft's 140 rotation after the device 100 is struck once, thereby holding one baseball 148 in place (that cannot be hit by a user) while teeing up the other baseball 144 (that can be hit by the user). The bristles 138 are preferably manufactured out of artificial materials such as a soft rubber, but can be manufactured in any other plastic, natural, or fabric material known in the art.

A top surface 112 of the base 110 receives the first frame member 120 and the second frame member 130. The first frame member 120 and the second frame member 130 are preferably fixedly attached to the base 110, but may be removable in some embodiments. The base 110 is preferably made of the same stainless steel material as the first frame member 120, second frame member 130, and vertical shaft 140, but may be manufactured from any plastic or metal material known in the art. The base 110 is preferably in the shape of a baseball home plate, but may be manufactured in any shape. To enhance the appearance of the device 100, the base 110 may be comprised of a plurality of decorative indicia 160, such as but not limited to: patterns, logos, emblems, images, symbols, designs, letters, words, characters, animals, advertisements, brands, etc. The base 110 is also preferably weighted such that the device 100 cannot topple over after being hit by a user.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "baseball training device" and "device" are interchangeable and refer to the baseball training device 100 of the present invention.

Notwithstanding the foregoing, the baseball training device 100 of the present invention and its various components can be of any suitable size and configuration as is known in the art without affecting the overall concept of the invention, provided that they accomplish the above-stated objectives. One of ordinary skill in the art will appreciate that the size, configuration and material of the baseball training device 100 as shown in the FIGS. are for illustrative purposes only, and that many other sizes and shapes of the baseball training device 100 are well within the scope of the present disclosure. Although the dimensions of the baseball training device 100 are important design parameters for user convenience, the baseball training device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A baseball training device comprising:

a base comprising an indicia on a top surface of the base;

a first frame member comprised of a first brush positioned on an interior surface of the first frame member and a first slotted opening positioned above the first brush;

a second frame member comprised of a second brush positioned on an interior surface of the second frame member and a second slotted opening positioned above the second brush;

a vertical shaft comprised of a first end having a first baseball and a second end having a second baseball;

a horizontal shaft attached to the vertical shaft and movable vertically within the first and second slotted openings; and a pair of rotating discs, wherein each disc is positioned along the horizontal shaft on opposing sides of the vertical shaft.

2. The baseball training device of claim 1, wherein the horizontal shaft can be raised or lowered within the first frame member and the second frame member.

3. The baseball training device of claim 1, wherein the vertical shaft rotates around the horizontal shaft.

4. The baseball training device of claim 1, wherein the base is shaped like a baseball home plate.

5. The baseball training device of claim 1, wherein the baseball training device is manufactured from a metal material.

6. A baseball training device comprising:

a base comprising an indicia on a top surface of the base;

a first frame member comprised of a first brush positioned on an interior surface of the first frame member and a first slotted opening positioned above the first brush;

a second frame member comprised of a second brush positioned on an interior surface of the second frame member and a second slotted opening positioned above the second brush;

a vertical shaft comprised of a first end having a first baseball and a second end having a second baseball;

a horizontal shaft fixedly attached to the vertical shaft at a midpoint of the horizontal shaft; and a pair of rotating discs, wherein each disc is positioned along the horizontal shaft on opposing sides of the vertical shaft; and wherein the horizontal shaft comprises a threaded knob at each end of the horizontal shaft and a head for threadedly engaging the respective threaded knob; and wherein the horizontal shaft can move vertically within the first and second slotted openings and is locked in place at a desired elevation by screwing each head onto the respective threaded knob penetrating the first and second slotted openings.

7. The baseball training device of claim 6, wherein the base is shaped like a baseball home plate.

8. The baseball training device of claim 6, wherein the first brush of the first member and the second brush of the second member are removably attached to the interior surface of the first member and the interior surface of the second member, respectively.

9. The baseball training device of claim 6, wherein a height of the vertical shaft is adjustable relative to the base.

10. A baseball training device comprising:

a stainless steel weighted base;

a first frame member comprised of a first brush positioned on and removably attached to an interior surface of the first frame member and a first slotted opening positioned above the first brush;

a second frame member comprised of a second brush positioned on and removably attached to an interior surface of the second frame member and a second slotted opening positioned above the second brush;

a vertical shaft comprised of a first end with a first baseball and a second end with a second baseball;

a horizontal shaft fixedly attached to the vertical shaft at a midpoint of the horizontal shaft; and a pair of rotating discs, wherein the vertical shaft is positioned between the pair of rotating discs; and wherein the horizontal shaft comprises a threaded knob at each end of the horizontal shaft and a head for threadedly engaging the respective threaded knob; and wherein the horizontal shaft can move vertically within the first and second slotted openings and is secured at a desired elevation by screwing each head onto the respective threaded knob penetrating the first and second slotted openings.

11. The baseball training device of claim 10, wherein the horizontal shaft extends through the first slotted opening of the first frame member and through the second slotted opening of the second frame member.

12. The baseball training device of claim 10, wherein each of the first brush of the first frame member and the second brush of the second frame member is comprised of a plurality of bristles.

13. The baseball training device of claim 12, wherein the plurality of bristles are comprised of a plastic, a natural material or a fabric material.

14. The baseball training device of claim 10, wherein the vertical shaft rotates around the horizontal shaft.

15. The baseball training device of claim 14, wherein rotation of the vertical shaft is stopped after 180 degrees by the first brush of the first frame member and the second brush of the second frame member.

16. The baseball training device of claim 10, wherein the base is shaped like a baseball home plate.

* * * * *